US010156117B2

(12) United States Patent
DeWesee, Jr.

(10) Patent No.: US 10,156,117 B2
(45) Date of Patent: Dec. 18, 2018

(54) COOLING OF ROTATING CONTROL DEVICE

(71) Applicant: Schlumberger Technology Corporation, Sugar Land, TX (US)

(72) Inventor: William DeWesee, Jr., Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 220 days.

(21) Appl. No.: 14/889,769

(22) PCT Filed: Nov. 5, 2015

(86) PCT No.: PCT/US2015/059289

§ 371 (c)(1),
(2) Date: Nov. 6, 2015

(87) PCT Pub. No.: WO2016/073752

PCT Pub. Date: May 12, 2016

(65) Prior Publication Data

US 2016/0290088 A1 Oct. 6, 2016

Related U.S. Application Data

(60) Provisional application No. 62/076,203, filed on Nov. 6, 2014.

(51) Int. Cl.
*E21B 33/08* (2006.01)
*E21B 36/00* (2006.01)
(Continued)

(52) U.S. Cl.
CPC ..... *E21B 33/085* (2013.01); *E21B 4/003* (2013.01); *E21B 36/00* (2013.01); *E21B 33/06* (2013.01)

(58) Field of Classification Search
CPC ..... E21B 33/085; E21B 36/00; E21B 4/003; E21B 33/06; E21B 33/08
See application file for complete search history.

(56) References Cited

U.S. PATENT DOCUMENTS 3,297,091 A * 1/1967 Dale ..... E21B 33/085 166/84.3
3,638,721 A * 2/1972 Harrison ..... E21B 33/064 166/351

(Continued)

FOREIGN PATENT DOCUMENTS

WO 2014/124419 A2 8/2014

OTHER PUBLICATIONS

International Search Report and Written Opinion for corresponding International Application No. PCT/US2015/059289, dated Jan. 27, 2016, 8 pages.

(Continued)

*Primary Examiner* — James G Sayre
(74) *Attorney, Agent, or Firm* — Paula B. Whitten

(57) ABSTRACT

A system comprises an outer housing, an inner housing, a first seal and a second seal. The outer housing comprises an inlet and an outlet. The inner housing is mounted inside the outer housing. The inner housing is dimensioned relative to the outer housing to allow for an annular space between the outer housing and the inner housing. The first seal and the second seal are mounted in the annular space so as to define a fluid chamber enclosed by the outer housing, the inner housing, the first seal and the second seal. The inlet and the outlet are in communication with the fluid chamber.

16 Claims, 6 Drawing Sheets

(51) Int. Cl.
*E21B 4/00* (2006.01)
*E21B 33/06* (2006.01)

(56) References Cited

U.S. PATENT DOCUMENTS

| | | | | |
|---|---|---|---|---|
| 5,279,365 | A * | 1/1994 | Yenulis | E21B 33/085 166/84.3 |
| 6,554,016 | B2 * | 4/2003 | Kinder | E21B 33/085 137/12 |
| 8,347,983 | B2 | 1/2013 | Hoyer et al. | |
| 2012/0055677 | A1 | 3/2012 | Boyd | |
| 2012/0217022 | A1 | 8/2012 | Michaud et al. | |

OTHER PUBLICATIONS

International Preliminary Report on Patentability for PCT/US2015/059289 dated May 18, 2017.

* cited by examiner

COOLING OF ROTATING CONTROL DEVICE

CROSS-REFERENCE TO RELATED APPLICATION

The present application is a National Phase of International Application No. PCT/US2015/059289 filed Nov. 5, 2015, which claims the benefit of U.S. Provisional Patent Application No. 62/076203, filed Nov. 6, 2014, which are hereby incorporated by reference in their entirety.

BACKGROUND

In drilling wellbores through subsurface formations, e.g., for extraction of materials such as hydrocarbons, a rotating control device (RCD) is directly or indirectly mounted on the top of a wellhead or a blowout preventer (BOP) stack. The BOP stack may include an annular sealing element (annular BOP), and one or more sets of "rams" which may be operated to sealingly engage a pipe "string" disposed in the wellbore through the BOP or to cut the pipe string and seal the wellbore in the event of an emergency.

The RCD is an apparatus used for well operations which diverts fluids such as drilling mud, surface injected air or gas and other produced wellbore fluids, including hydrocarbons, into a recirculating or pressure recovery "mud" (drilling fluid) system. The RCD serves multiple purposes, including sealing tubulars moving in and out of a wellbore under pressure and accommodating rotation and longitudinal motion of the same. Tubulars can include a kelly, pipe or other pipe string components, e.g., parts of a "drill pipe string" or "drill string".

Typically, a RCD incorporates three major components that work cooperatively with one another to hydraulically isolate the wellbore while diverting wellbore fluids and permitting a pipe string (e.g., a string) to rotate and move longitudinally while extending through the RCD. An outer stationary housing having an axial bore is hydraulically connected to the wellhead or BOP. The outer stationary housing can have one or more ports (typically on the side thereof) for hydraulically connecting the axial bore of the housing to return flow lines for accepting return wellbore fluids. A bearing assembly is replaceably and sealingly fit within the axial bore of the outer housing for forming an annular space therebetween.

The bearing assembly comprises a rotating inner cylindrical mandrel replaceably and sealingly fit within a bearing assembly housing. An annular bearing space is formed between the rotating inner cylindrical mandrel and the bearing assembly housing for positioning bearings and sealing elements. The bearings permit the mandrel to rotate within the bearing assembly housing while the sealing elements isolate the bearings from wellbore fluids.

BRIEF DESCRIPTION OF THE DRAWINGS

These and other aspects are better understood when the following detailed description is read with reference to the accompanying drawings, in which.

DETAILED DESCRIPTION

Figure 1:
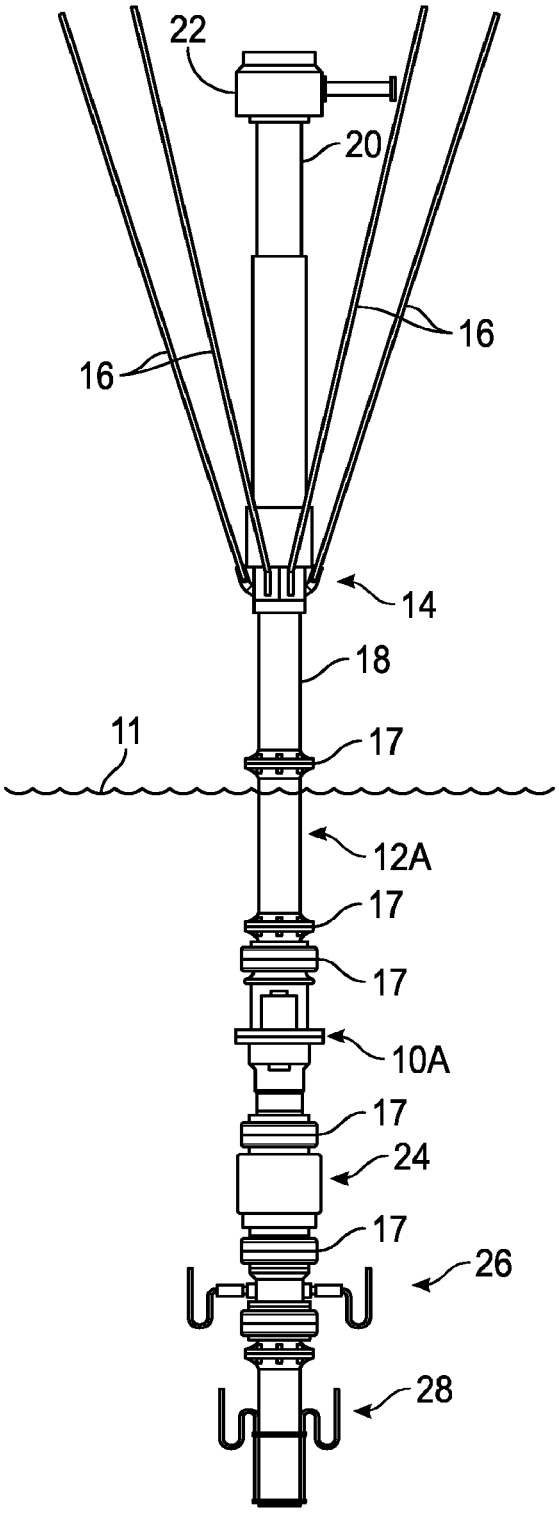
FIG. 1 PRIOR ART
FIG. 1 is a schematic representation of a conventional rotating control device (RCD)

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

A rotating control device (RCD), also known as a rotating flow head (RFH), generally comprises an outer stationary housing supported on a wellhead, and a rotating cylinder mandrel, such as a quill for establishing a seal to a movable tubular such as a tubing, drill pipe or Kelly. The mandrel is rotatably and axially supported by a bearing assembly comprising bearings and seal assemblies for isolating the bearing assembly from pressurized wellbore fluids.

FIG. 1 illustrates an RCD installation known in the art as used in connection with deep water drilling unit ("rig") platforms. The RCD 10A is supported on a submerged annular BOP 24, in a body of water 11 such as a lake or ocean, below a marine riser tensioning ring 14. Tension is applied to the riser tensioning ring 14 through tensioning lines 16 connected to the drilling rig or other buoyant devices. Returning flow lines (not shown) extend radially from the. RCD 10A and are in fluid communication with a surface recirculating or pressure recovery mud system on a floor of the rig. Such system may include a slip joint 20 and return diverter 22. The slip joint 20 enables the marine riser 18 to change length in response to heave of the drilling rig (not shown). Flow spools 26, 28 may be disposed below the annular BOP 24 to provide hydraulic communication to the interior of the wellbore through, e.g., "choke" lines, "kill" lines and/or "booster" lines. The example shown in FIG. 1 has the various components of the riser system coupled to each other by bolted together flanges 17, although such couplings are not the only types which may be used in various examples of the system. The riser may include a flex joint or pup joint 12A for spacing and lateral force accommodation.

Figure 2:
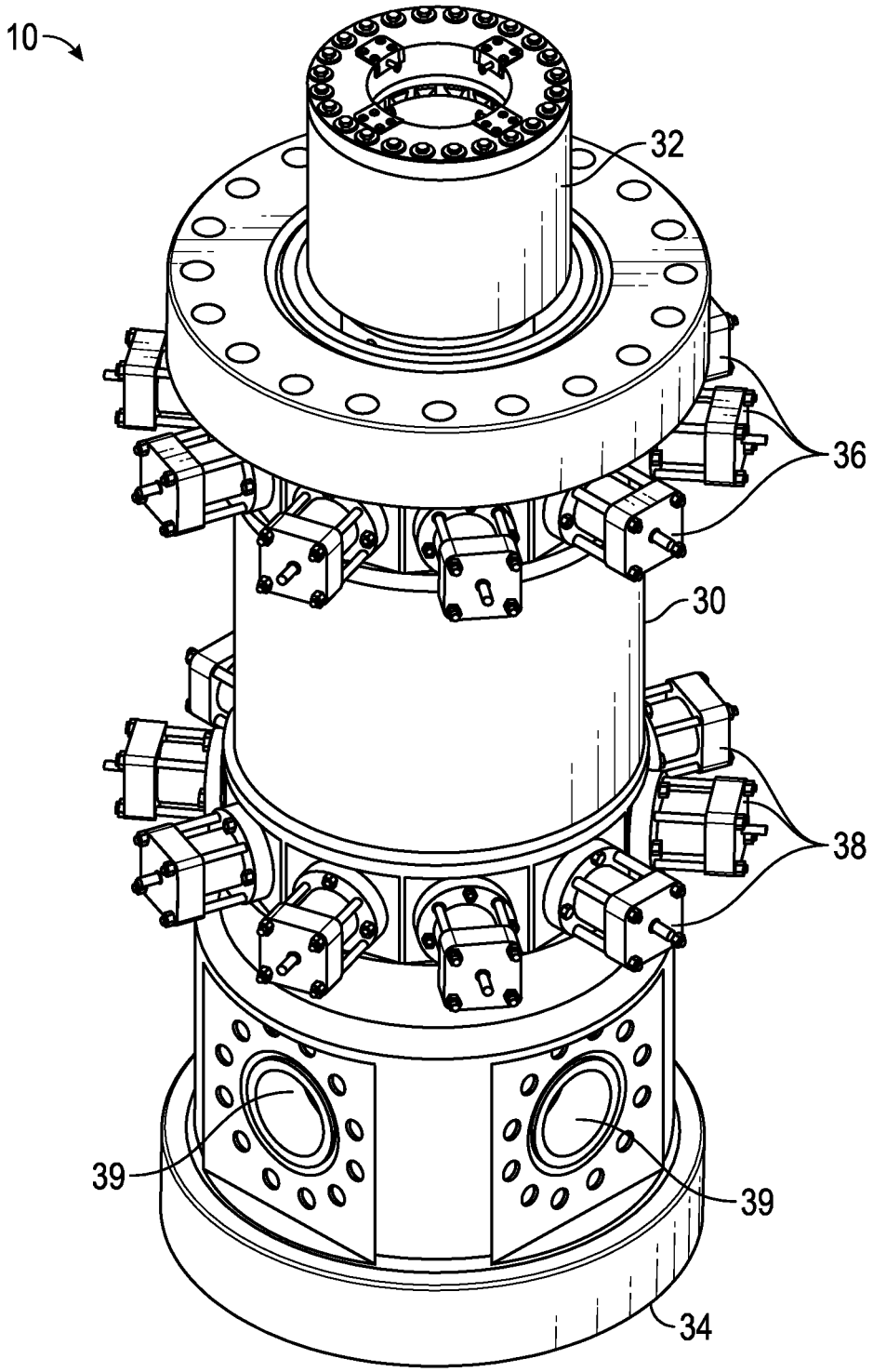
FIG. 2 is a perspective view of an example embodiment of an RCD shown with an upper array of locking fasteners and a lower array of locking fasteners.

FIG. 2 illustrates an example rotating control device (RCD) 10 used in marine drilling comprising an outer, stationary housing ("RCD housing") 30 having a connector 34 (e.g., but not limited to a bolted flange) at a lower end to operatively connect the RCD housing 30 to a marine riser (e.g., as shown in FIG. 1) at a longitudinal position above the a riser tensioning ring (14 in FIG. 1). The RCD housing 30 further comprises one or more side ports 39 for redirecting wellbore fluids entering the RCD housing 30 from below to fluid return flow lines (not shown) hydraulically connected to the pressure recovery mud system (not shown). Upper and lower arrays of locking fasteners 36, 38 that are radially extensible and retractable (in the present example, these may be lag bolts) may be circumferentially spaced around the RCD housing 30 for selectively locking and unlocking functional components of the RCD 10 within the RCD housing bore. Such functional components may include a bearing assembly having an inner cylindrical mandrel 32.

Although FIGS. 1-2 illustrate RCD 10A below the riser tensioning ring 14, the present disclosure is compatible with an RCD above the riser tensioning ring 14 or an RCD located in an onshore environment.

The RCD housing 30 may include therein a replaceable bearing assembly 37 comprising a bearing assembly housing 40 having therein an inner cylindrical mandrel 32 permitting sealing passage therethrough of a tubular such as a drill string,. The replaceable bearing assembly 37 (FIG. 3) is supported and may be locked in place in the RCD housing 30 by the lower array of locking fasteners 38, while the upper array of locking fasteners 36 also secures the bearing assembly 37 within the RCD housing 30.

Figure 3:
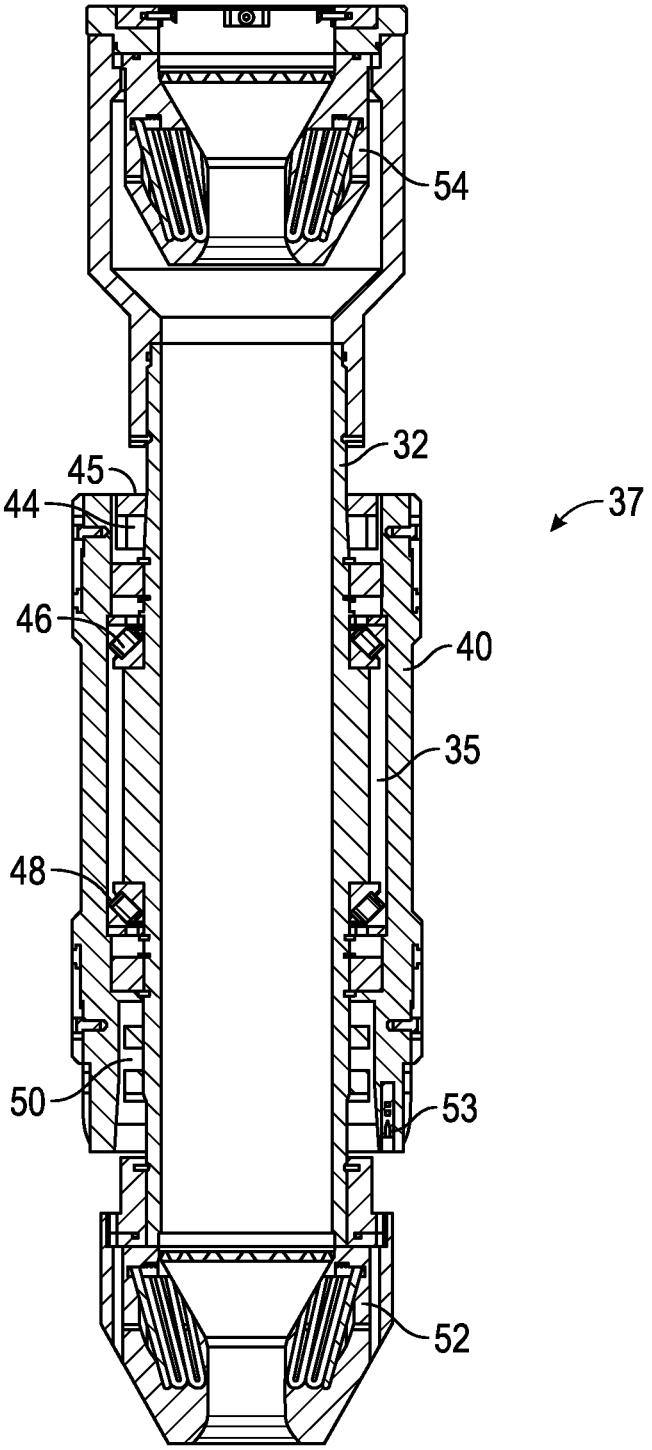
FIG. 3 is a side cross-sectional view of an example embodiment of a bearing assembly illustrating an bearing assembly housing, an inner cylindrical mandrel and packing.

As shown in FIG. 3, the inner cylindrical mandrel 32 comprises a lower sealing ("stripper") element 52, and can further comprise an upper sealing ("stripper") element 54 for sealing around the tubular (e.g., a drill string) passing through the mandrel 32.

The replaceable bearing assembly 37 may comprise the rotatable inner cylindrical mandrel 32, adapted for the sealing passage of a drill string or other tubular passing therethrough. The mandrel 32 passes through a bearing assembly housing 40 as shown in FIG. 3. The bearing assembly housing 40 and the inner cylindrical mandrel 32 form an annular bearing space 35 therebetween for fitment of bearings (upper and lower respectively shown at 46 and 48) and sealing elements (upper and lower shown respectively at 44 and 50). The bearing assembly housing 40 and the inner cylindrical mandrel 32 may be secured to one another by way of a plurality of bolts 53 at a downhole end of the bearing assembly housing 40.

In FIG. 3, the upper 46 and lower 48 bearings, which may be tapered roller bearings, radially and axially support the inner cylindrical mandrel 32 within the bearing assembly housing 40. The upper 46 and lower 48 bearings may also be sufficiently axially spaced apart to compensate for any flexing or deflections experienced by the RCD a result of swaying of the drilling rig platform, and any flexing of a tubular (e.g., a drill string) passed through the inner cylindrical mandrel 32.

Between a top plate 45 in the bearing assembly housing 40 and the upper bearings 46 may be an upper sealing element or a stack of such elements, shown generally at 44. A lower sealing element 50 or stack thereof may be disposed below the lower bearings 48. The upper 44 and lower 50 sealing elements isolate the upper 46 and lower 48 bearings from wellbore fluids. Both the upper 44 and lower 50 scaling elements can be replaceable seal stacks comprising individual seals. The cylindrical mandrel 32 may include an upper sealing ("stripper") element 54 and a lower sealing ("stripper") element 52 which will be further explained below.

Figure 4:
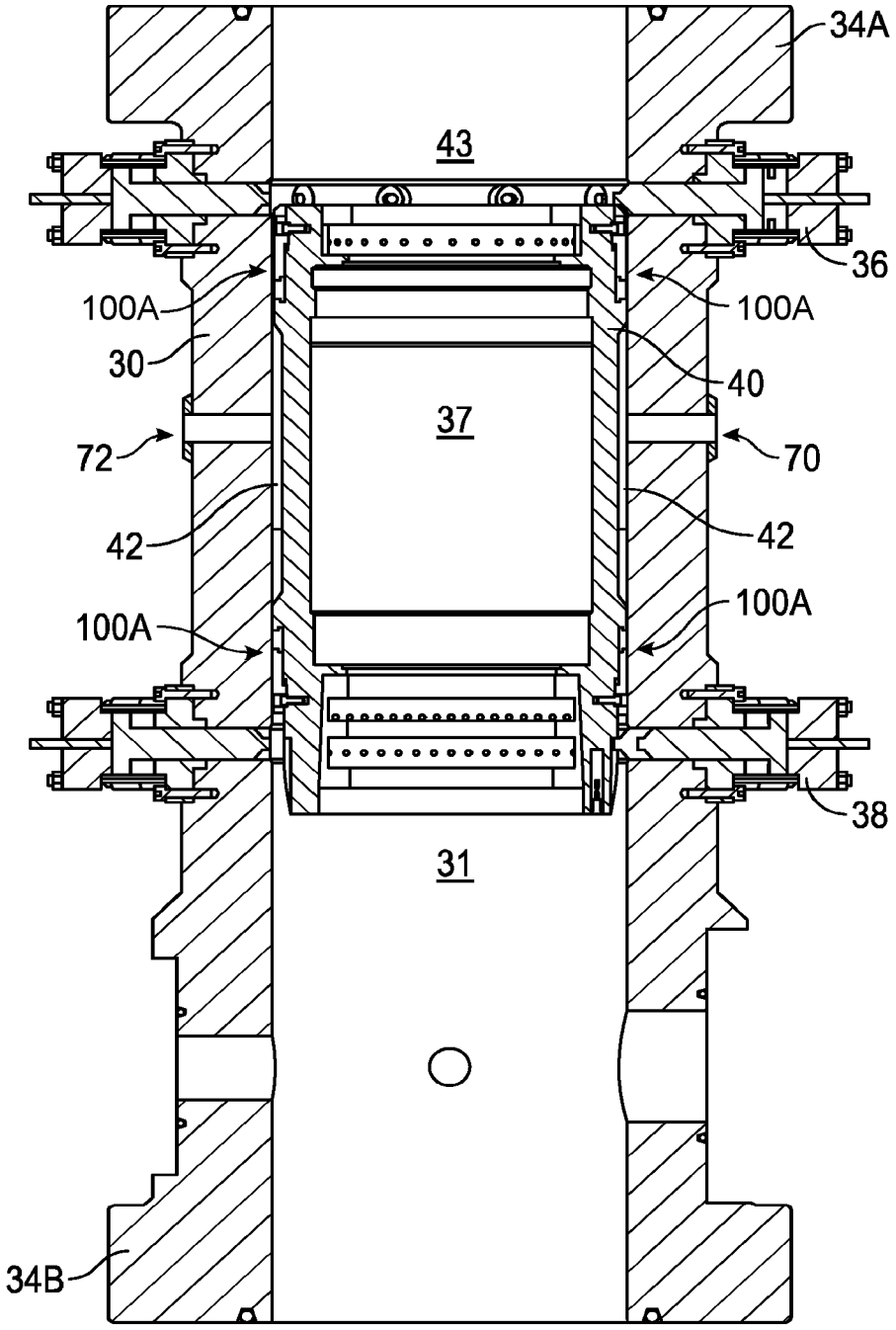
FIG. 4 is a side cross-sectional view of an example embodiment of a RCD housing illustrating the upper and lower arrays of locking fasteners and packing to seal an annular space between the bearing assembly housing and the RCD housing.

FIG. 4 illustrates the bearing assembly 37 with the bearing assembly housing 40 thereof replaceably disposed within the RCD housing bore 31. As shown in FIG. 4, the lower array of locking fasteners 38 (e.g., lag bolts), in their extended position, engage the bearing assembly housing 40 to support the bearing assembly 37 within the RCD housing bore 31. The upper array of locking fasteners 36 can be actuated into their extended position to secure the bearing assembly 37 within the RCD housing 30. The upper locking fasteners 36 may engage a top end 43 of the bearing assembly housing 40. Either or both the upper locking fasteners (e.g., lag bolts) and the top end 43 may be shaped, e.g., tapered so the locking fasteners in the upper array 36 may, when extended to their closed position, apply a downward longitudinal force on the bearing assembly housing 40 for securing the bearing assembly 37 in the RCD housing 30.

The bearing assembly housing 40 may further comprise an annular space 42 above the lower array of locking fasteners 38. The RCD housing 30 may comprise ports that operate as an inlet 70 and an outlet 72 leading to the annular space 42. The inlet 70 and the outlet 72 may be used to supply fluid to the annular space 42. A sealing system 100A may be fit below and adjacent the annular space 42 to isolate wellbore fluids from entering the annular space 42 between the exterior of the bearing assembly housing 40 and the interior of the RU) housing 30. The sealing system 100A may include a packing 66 that is energized to seal the annular bearing space 42 between the bearing assembly housing 40 and the RCD housing 30 by expanding radially inwardly and outwardly. The radial inward and outward expansion of the packing 66 may be actuated by the downward axial movement of the bearing assembly housing 40 when secured within the RCD housing 30 by the foregoing action on the top 43 of the bearing assembly housing 40 by the upper array of locking fasteners 36 when extended. The engagement of the upper array of locking fasteners 36 with the top 43 of the bearing housing 40 may thus fully activate the packing 66.

Figure 5:
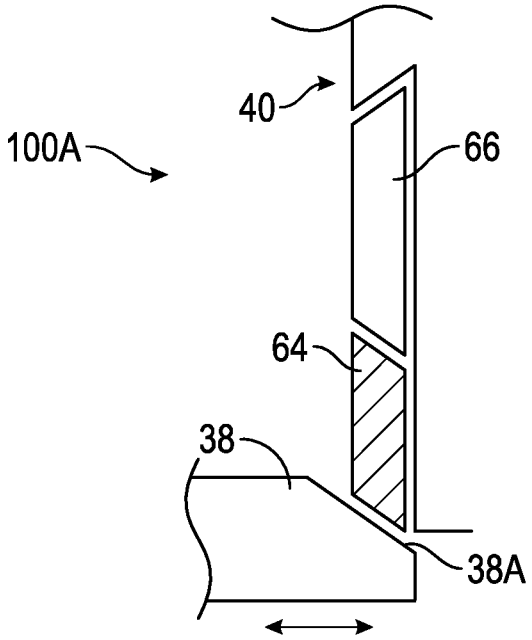
FIG. 5 is a close-up, side cross-sectional view of the packing near one of the locking fasteners.

An example embodiment of the sealing system 100A is illustrated in FIG. 5. The configuration shown in FIG. 5 may correspond to the configuration near the lower array of locking fasteners 38. The packing 66 may be actuated by the insertion of a locking fastener 38 into the bearing assembly housing as shown in FIG. 5. The locking fastener 38 may have a tapered end 38*a* which may engage an annular actuating element 64 such that the actuating element 64 moves upward along the longitudinal axis of the bearing housing 40 as the locking fastener 38 moves radially inward. The upward movement of the actuating element 64 traps the packing 66 between the actuating element 64 and the bearing housing 40 thereby causing the packing 66 to expand outward due to the insertion of the locking fastener 38 and at least the weight of the RCD housing 30. Once the locking fasteners 36, 38 are mounted, the upper and lower packings 66 are located between the locking fasteners 36, 38 with respect to the longitudinal axis of the RCD housing 30.

The packing 66 near the upper array of locking fasteners 36 is similar in configuration to the configuration shown in FIG. 5 except that the arrangement of components would be upside down as in a mirror image. Insertion of the locking fastener 36 pushes the actuating element 64 downward causing the packing 66 to expand radially outward. The downward force caused by the insertion of the lag bolt and the resistance caused by the locking of the lower array of locking fasteners 38 against such downward force squeeze the packing 66. As a result, an annular fluid chamber 56 is formed by the annular bearing space 42 being enclosed by the upper packing 66, the exterior of the RCD housing 30, the lower packing 66 and the interior of the bearing housing 40.

Those skilled the art will appreciate that a packing may have advantages over a convention O-ring sealing element in such configuration, because a packing is not as susceptible to damage when the bearing assembly 37 is inserted and retrieved from the RCD housing 30. The annular space 42 further functions to centralize the bearing assembly housing 40 within the RCD housing bore 31.

Figure 6:
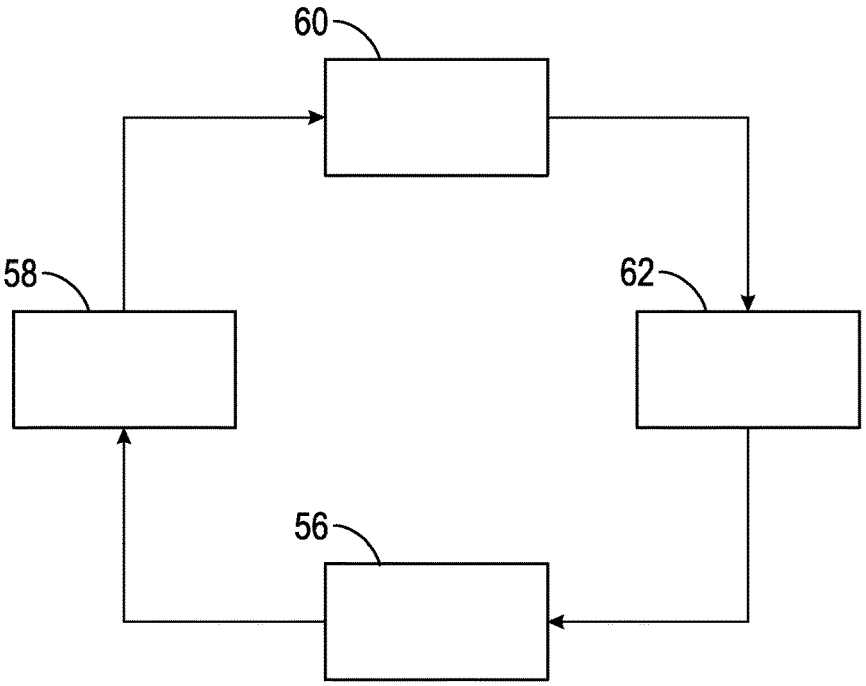
FIG. 6 is a schematic illustration of a loop through which fluid from a fluid chamber circulates.
Figure 7:
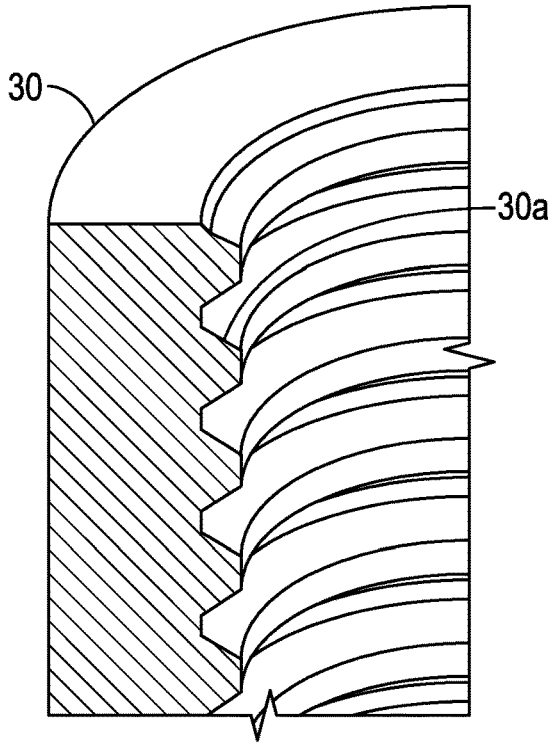
FIG. 7 is a close-up, side cross-sectional view of the RCD housing illustrating spiral grooves on an inner surface thereof.

As shown in FIG. 6, the fluid chamber 56 may be part of a loop through which fluid circulates. The fluid may be used to cool the RCD 10 and components therein. Thus, the loop may include the fluid chamber 56, a filter 58, a chiller 60 and a pump 62. The filter 58 may be used to remove contaminants from the fluid which may be a drilling fluid. The chiller 60 may be a type of heat exchanger that removes heat from the fluid to allow the fluid to cool the RCD 10 and the components while moving therethrough. The pump 62 drives the fluid throughout the loop. In order to increase heat exchange through increased surface area and to promote movement of the fluid through the fluid chamber 56, the inner surface of the RCD housing 30 may include spiral grooves 30*a* as shown in FIG. 7.

In one example aspect, a system includes an outer housing, an inner housing, a first seal and a second seal. The outer housing includes an inlet and an outlet. The inner housing is mounted inside the outer housing. The inner housing is dimensioned relative to the outer housing to allow for an annular space between the outer housing and the inner housing. The first seal and the second seal are mounted in the annular space so as to define a fluid chamber enclosed by the outer housing, the inner housing, the first seal and the second seal. The inlet and the outlet are in communication with the fluid chamber.

In another example aspect, a system includes an outer housing, an inner housing and a circulation loop. The inner housing is mounted inside the outer housing. The inner housing is dimensioned relative to the outer housing to allow for an annular space between the outer housing and the inner housing. A portion of the annular space is enclosed to form a fluid chamber. The circulation loop is in fluid communication with the fluid chamber and includes a chiller and a pump. The circulation loop moves fluid through the fluid chamber.

In yet another example aspect, a method of cooling a rotating control device is disclosed. The rotating control device includes an outer housing, an inner housing, a first seal and a second seal. The method includes positioning the first seal and the second seal in the annular space between the outer housing and the inner housing. The method further includes actuating the first seal and the second seal so as to define a fluid chamber enclosed by the outer housing, the inner housing, the first seal and the second seal. The method further includes moving cooling fluid through the fluid chamber.

Although the preceding description has been described herein with reference to particular means, materials, and embodiments, it is not intended to be limited to the particulars disclosed herein; rather, it extends to all functionally equivalent structures, methods, and uses, such as are within the scope of the appended claims.

What is claimed is:

1. A system comprising:

an outer housing comprising an inlet and an outlet;

an inner housing mounted inside the outer housing, the inner housing dimensioned relative to the outer housing to allow for an annular space between an inner surface of the outer housing and an outer surface the inner housing;

a first seal and a second seal mounted in the annular space so as to define a fluid chamber enclosed by the outer housing, the inner housing, the first seal and the second seal, and first locking fasteners and second locking fasteners, that are radially extensible and retractable, circumferentially spaced around the outer housing, wherein the inlet and the outlet are in fluid communication with the fluid chamber and the first seal and second seal are located in the annular space between the first locking fasteners and the second locking fasteners longitudinally with respect to the outer housing when the first locking fasteners and the second locking fasteners are located in extended positions.

2. The system of claim 1, wherein each of the first and second locking fasteners securing the outer housing to the inner housing, the first locking fasteners are configured for actuating the first seal, and the second locking fasteners are configured for actuating the second seal.

3. The system of claim 2, wherein the first seal and the second seal are actuated by compression.

4. The system of claim 3, wherein the first seal and the second seal are compressed in a direction of a longitudinal axis of the outer housing and expand radially with respect to the longitudinal axis.

5. The system of claim 1, wherein the outer housing is part of a rotating control device.

6. The system of claim 1, wherein the inner housing comprises a bearing assembly.

7. The system of claim 1, wherein drilling fluid moves in and out of the fluid chamber through the inlet and the outlet respectively.

8. The system of claim 1, wherein the inner surface of the outer housing, facing the outer surface of the inner housing between the first seal and the second seal, comprises spiral grooves.

9. A method of cooling a rotating control device, the rotating control device comprising an outer housing, an inner housing, a first seal and a second seal, the method comprising:

positioning the first seal and the second seal in an annular space between the outer housing and the inner housing;

actuating the first seal and the second seal by radially extending first and second fasteners inwardly with respect to the inner housing so as to define a fluid chamber enclosed by the outer housing, the inner housing, the first seal and the second seal, wherein the first seal, the second seal and the fluid chamber are located between the radially extended first and second fasteners; and moving cooling fluid through the fluid chamber.

10. The method of claim 9, wherein the cooling fluid is drilling fluid.

11. The method of claim 9, further comprising cooling the fluid after the moving of the cooling fluid through the fluid chamber.

12. The method of claim 11, further comprising filtering the cooling fluid after the moving of the cooling fluid through the fluid chamber.

13. The method of claim 11, further comprising recirculating the cooling fluid to the fluid chamber.

14. The method of claim 9, further comprising creating a spiraling movement of the cooling fluid during the moving by providing spiral grooves on an inner surface of the outer housing facing an outer surface of the inner housing.

15. The method of claim 9, wherein the first seal and the second seal are actuated by securing the outer housing to the inner housing.

16. The method of claim 9, wherein the actuating involves compressing the first seal and the second seal.

* * * * *